US005092108A

United States Patent [19]

Gottfreid

[11] Patent Number: 5,092,108

[45] Date of Patent: Mar. 3, 1992

[54] COMPRESSION AND AFFIXING OF CARTON LID

[75] Inventor: Thomas M. Gottfreid, Mundelein, Ill.

[73] Assignee: Moore Business Forms, Inc., Grand Island, N.Y.

[21] Appl. No.: 624,692

[22] Filed: Dec. 6, 1990

[51] Int. Cl.[5] ..... B65B 51/02; B65B 7/28

[52] U.S. Cl. ..... 53/526; 53/377.4; 53/387.2

[58] Field of Search ..... 53/387.2, 383.1, 382.1, 53/377.4, 377.5, 377.2, 526, 378.3; 493/131, 130, 150

[56] References Cited

U.S. PATENT DOCUMENTS

| | | | |
|---|---|---|---|
| 3,443,353 | 5/1969 | De Vecchio | 53/377.4 X |
| 3,710,536 | 1/1973 | Lee et al. | 53/526 X |
| 3,872,652 | 3/1975 | LaBantschnig et al. | 53/377.4 |
| 3,979,876 | 9/1976 | Moore et al. | 53/387.2 X |
| 4,203,355 | 5/1980 | Meyers | 53/133.1 X |
| 4,553,954 | 11/1985 | Sewell et al. | 493/131 X |
| 4,894,104 | 1/1990 | Hemus | 53/387.2 X |

*Primary Examiner*—James F. Coan
*Attorney, Agent, or Firm*—Nixon & Vanderhye

[57] ABSTRACT

Packing apparatus provides for essentially automatic packing of a cardboard carton at a significantly reduced cost compared to conventional strapping equipment and procedures. The carton preferably used with the packing apparatus includes a cardboard carton lid that is constructed so that the carton may be securely packed and shipped without the necessity for plastic strapping, and using lower strength paperboard than is conventionally provided, and is used with a carton body having side walls. The lid has elongated side panels with first and second parallel lines of weakness (e.g. perforations) formed in them. The bottom, fastening portion, of the side panels is preferably secured to the carton body side walls by cam elements of the apparatus moving the side panels outwardly from the carton side walls, and apparatus for applying adhesive to them while in that position. The carton is packed with nondeformable material such as business forms which extend above the top edge of the carton. The apparatus pushes down on the lid, compressing the material within the carton, to reduce voids in the material, and the components are maintained in the compressed condition as the side panels are adhesively attached to the carton body side walls, without interfering with the ability of the lid to flex at its lines of weakness.

18 Claims, 3 Drawing Sheets

COMPRESSION AND AFFIXING OF CARTON LID

BACKGROUND AND SUMMARY OF THE INVENTION

Business forms, paper, and many other products are conventionally shipped and stored in two piece cartons having a carton body and a top, both of cardboard. Since it is highly desirable for the carton lids to be reused in such cartons, the carton lid is typically secured to the carton body by plastic straps. This is an expensive procedure, however, since there is a substantial investment in automatic strapping equipment, since the plastic straps are relatively expensive, and since there are significant maintenance costs associated with the automatic strappers. Therefore, it is highly desirable to provide a carton with a reusable lid that may be shipped without plastic strapping, while still securely maintaining the carton contents.

Further, in conventional corrugated cartons, during shipping and handling varying amounts of weight and momentum are applied to the carton. This has led many users of cartons to build higher cost and higher strength corrugated paperboard cartons in order to maintain a rigid box of unchanging depth. However, if the box is able to flex to accommodate varying amounts of weight and momentum that are applied during shipping and handling, lower cost paperboard may be utilized, yet the carton will retain its integrity and uniformity throughout its useful life. This is especially desirable in the area of packing paper products, such as business forms, which tend to expand and contract over time and to settle after initial packing since voids are common in the depth dimension.

It is also necessary, if appropriate production speeds are to be achieved, to be able to produce cartons that solve the above mentioned problems with automated equipment, rather than requiring hand construction of the cartons.

According to the present invention, an apparatus is provided which effects construction of a carton which solves the above mentioned problems in a simple and effective manner. According to the present invention the expensive strapping equipment necessary for most commercial carton packaging systems is eliminated, the cost of materials for packaging are greatly reduced, and since the equipment utilized to effect packaging according to the invention is much less expensive with a much simpler construction, equipment maintenance costs are substantially reduced. For example, according to the present invention the apparatus for effecting packaging can be about one-fifth the cost of conventional strapping equipment, while the operating cost per thousand cartons is less than one-tenth, and almost no maintenance is required.

The invention comprises apparatus for packing and securing a cardboard carton. The carton utilized is preferably the carton disclosed in copending U.S. application Ser. No. 07/583,371 filed Sept. 17, 1990. According to one aspect of the invention, the apparatus comprises: Means for providing a compressive force to the lid so that the lid moves downwardly toward the carton body top edge. Means for moving the lid overlapping side panels away from the carton side walls, and applying adhesive thereto and/or to the cooperating portions of the carton side walls. And, means for maintaining compressive force on the lid and applying inward compressive force to the lid overlapping side panels to adhesively bond the overlapping side panels to the side walls.

The means for providing a compressive force preferably comprise a bottom conveyor, such as a plurality of rollers, and a top conveyor, such as a plurality of rollers that are slanting so as to provide a constantly decreasing height so as to effect gradual compression of the carton in the vertical dimension. A cam and applicator comprise the means for moving the lid overlapping side sections away from the carton side walls and applying glue to the carton side wall and/or the overlapping lid side sections. The means for maintaining the compressive force may comprise a plurality of vertical axis rollers biased horizontally into engagement with the side sections of the lid.

According to another aspect of the apparatus according to the invention, the apparatus comprises: Means for providing a compressive force to the carton lid so that the lid moves downwardly toward the carton body top edge. Means for attaching the lid overlapping side panels to the carton side walls; and means for maintaining compressive force on the lid and applying inward compressive force to the lid overlapping side panels coincident with action by the means for attaching the lid overlapping side panels to the carton side walls. The attaching means preferably comprises the adhesive applying means described above, but may also comprise means for spraying adhesive, or stapling or taping equipment.

According to another aspect of the apparatus of the invention, apparatus is provided comprising means for moving the carton lid overlapping side panels away from the carton side walls, and applying adhesive thereto and/or to the cooperating portions of the carton side walls, this means comprising a wedge shaped cam element for movement between the lid side panels and the carton body side wall disposed on each side of the carton to cam the side panel away from the carton wall, and an adhesive applicator for transferring adhesive to at least one of the interior of the side panel or exterior of the carton side wall as it moves therepast; and means for applying an inward compressive force to the lid overlapping side panels to adhesively bond the overlapping side panels to the side walls.

It is the primary object of the present invention to provide apparatus for effectively, simply, and inexpensively packing a carton and attaching the lid to the carton. This and other objects of the invention will become clear from an inspection of the description of the invention and from the appended claims.

DETAILED DESCRIPTION OF THE DRAWINGS

Figure 1:
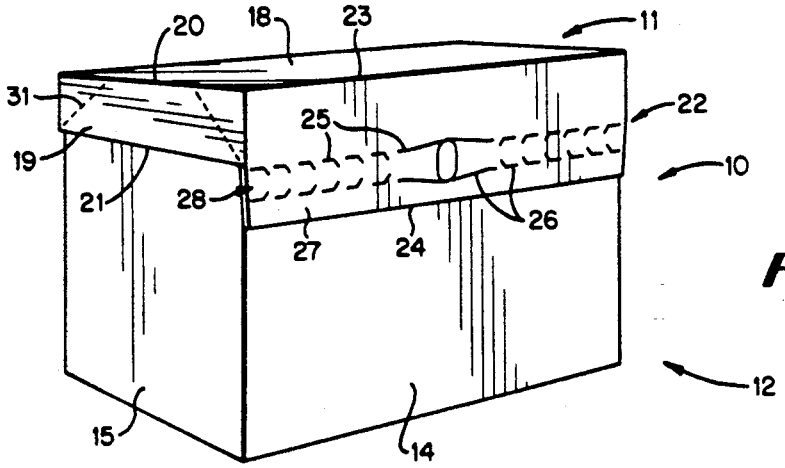
FIG. 1 is a top perspective view of an exemplary cardboard carton that may be packed and secured using apparatus according to the present invention.

An exemplary cardboard carton that is acted upon using the apparatus according to the present invention is shown generally by reference numeral 10 in FIG. 1. While the term "cardboard" will be used throughout the specification and claims, it is to be understood that such term is used only generically, and includes corrugated and non-corrugated cardboard and/or paperboard, and all like materials typically used in cartons. The carton per se is the subject of copending application Ser. No. 07/583,371 filed Sept. 17, 1990.

The main components of the cardboard carton 10 comprise a lid 11 and a body 12. The body 12 has a bottom 13 (see FIG. 3), a pair of end walls 15, and a pair of side walls 14. It also has an open top defined by a top edge 16 (see FIG. 3). Except for the weight of the cardboard utilized, the bottom 12 is a conventional carton bottom of the type commonly used for packaging paper products, such as business forms, and the like.

The lid 11 of the carton is preferably significantly different than conventional cardboard carton lids. The lid 11 includes a top 18 and a pair of end sections or panels 19, the end panels 19 have a top edge 20 connected to the top panel 18 and a bottom edge 21, the edges 20 and 21 spaced a first spacing, typically about three inches. The end sections 19 are substantially perpendicular to the top panel 18.

The lid 11 also comprises at least one—and preferably two—side panels 22, each having a top edge 23 thereof and a bottom edge 24, the spacing between the top edge 23 and the bottom edge 24 being a second spacing which is significantly greater than the first spacing. The panel 22 is also connected to the top panel 18 at the top edge 23 thereof, and is generally perpendicular to both the top panel 18 and the side panels 19.

Figure 5:
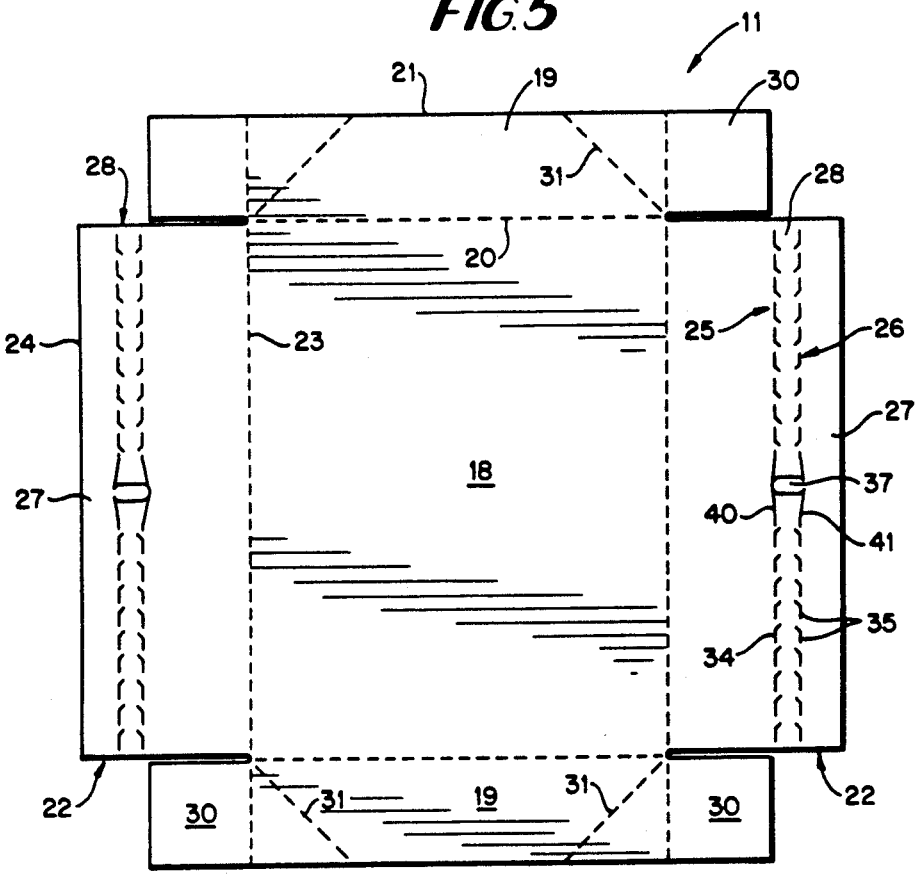
FIG. 5 is a top plan view of a blank for making the lid of the carton which is ultimately secured to the carton using the apparatus according to the invention.

Although not apparent in the other figures, as can be seen in FIG. 5, the end panels 19 preferably have a pair of ears 30 extending from each, and pre-fold score lines 31 therein, both of which are conventional. As is conventional, the ears 31 are tucked inside the side panels 22 and affixed to the side panels 22 with adhesive or other fasteners (e.g. staples).

Disposed in the side panels 22 are first and second lines of weakness 25, 26, preferably formed by perforations (34, 35) that are substantially parallel to each other and to top edge 23 and bottom edge 24. Between the bottom, second, line of weakness 26 and the bottom edge 24 is a section 27 of the side panel 22 which has a sufficient dimension to be securely attached to the side wall 14 of the carton body 12. Most desirably, the first, top, line of weakness 25 is disposed in alignment with the bottom 21 of the end panels 19 (e.g. about three inches from the top edge 23), and the spacing between the lines of weakness 25, 26 is about ½ to 1 inch, and the width of the bottom section 27 (the spacing between second line of weakness 26 and bottom edge 24) is about ¾–1½ inches. A removable strip 28 is provided between the lines of weakness 25, 26.

Figure 2:
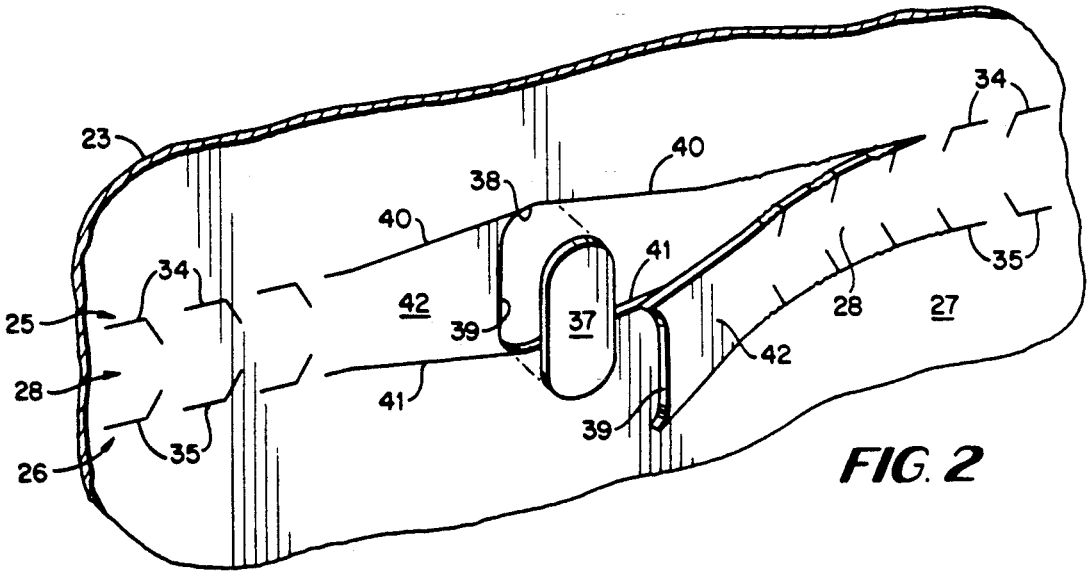
FIG. 2 is a detailed view of one of the side sections of the lid of the carton of FIG. 1 showing the manner of detachment thereof.

The carton lid 11 is also constructed so as to further provide means for facilitating grasping of the removable strip 28 to allow tearing of the side section at the perforations defining the lines of weakness 25, 26 so that the section 27 is detached from the rest of the lid 11. This is preferably accomplished—with particular reference to FIGS. 2 and 5—by providing a die cut blank 37, having a die cut 38 at the top and bottoms thereof, and side die cuts 39 with the removable strip 28, the blank 37 being provided in substantially the center of the side panel 22. The means for facilitating grasping further preferably comprise die cut lines 40, 41 extending from both sides of the blank 37 and formed at a slight angle with respect to the rest of the lines of weakness 25, 26 so as to provide enlarged grasping portions 42 in the strip 28. The perforations 34, 35 are parallel to each other, and generally in line with the die cut lines 40, 41, and may have the configuration illustrated in FIGS. 2 and 5, although other configurations are also possible, as long as they allow relatively ready detachment of the strip 28.

Figure 3:
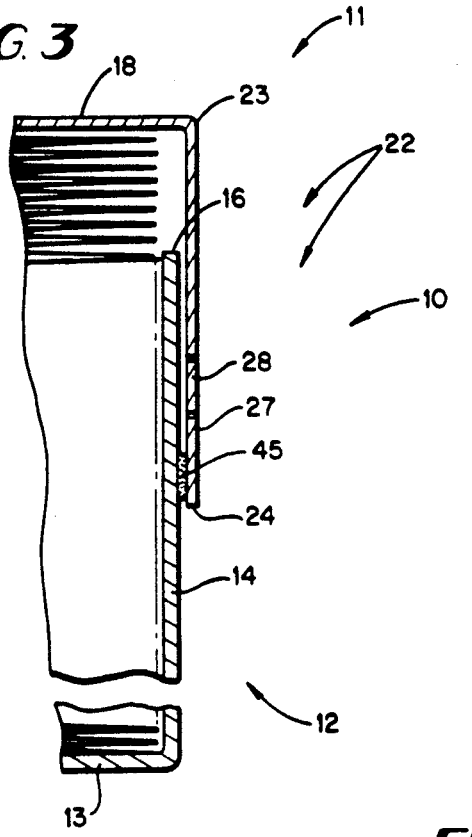
FIG. 3 is a side detail cross-sectional view of the carton of FIG. 1, with the business forms packed thereby shown in elevation.

As seen in FIG. 3, the carton 10 is filled with substantially nondeformable (that is non-permanently deformable) material, in the particular case illustrated in FIG. 3 a plurality of paper sheets, in the form of continuous business forms, multipart business forms (whether continuous or detached), or like products. The product extends in a stack upwardly from the bottom 13 past the top edge 16 of the carton body 12. The carton is then compressed by pushing down on the lid 11—as will be hereafter described—to reduce the void volume within the stack of business forms or like product, and then adhesive 45—or like fastening means—is utilized to affix the bottom sections 27 of the side panels 22 to the carton body side walls 14.

Figure 4:
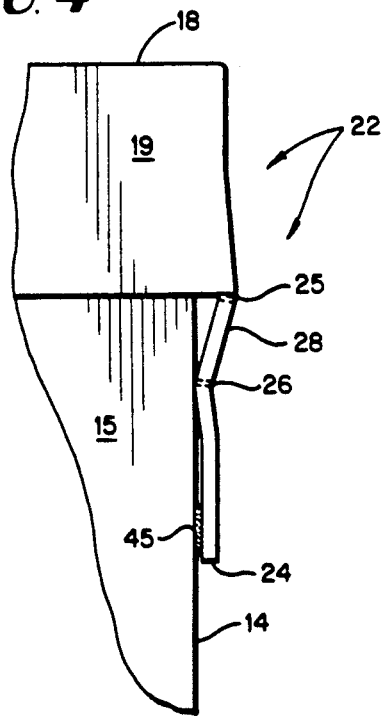
FIG. 4 is a side detail view showing the flexing action of the carton to accommodate varying loads and momentum applied during shipping and handling.

With the above-identified overpacking of the carton 10, and compressing thereof, the lines of weakness 25, 26 will inherently form flex areas, so that when the carton 10 is subjected to varying loads and momentum during shipping and handling, the carton components can flex (see FIG. 4) rather than having to be rigid enough to withstand such forces without any deformation. This ability to "give" in response to applied forces rather than having to be strong enough to resist such forces allows the carton 10 to be constructed of lower weight paperboard, and does not require the use of filler pads. For example, in conventional packaging of business forms, 200 pound test boxes with or without extra strength 33 pound mediums, and corrugated and Styrofoam ® filler pads, are utilized. However for the carton 10, there is no need for any fillers, and 125 pound, 150 pound or 175 pound test corrugated paperboard may be utilized for both the carton body and the lid. While more paperboard material (square footage) is necessary because of the elongated side panels 22, since the weight is less, the cost of the carton 10 will be less than that of a comparable conventional carton having the same protecting qualities.

Figure 8:
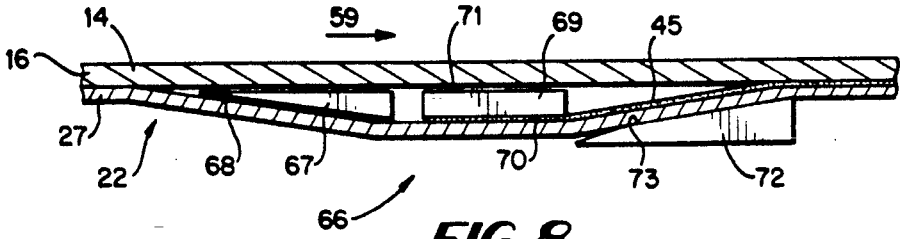
FIG. 8 is a top detail view of the gluing section components of the inventive apparatus of FIGS. 6 and 7, shown in association with a carton side wall and lid side section.
Figure 6:
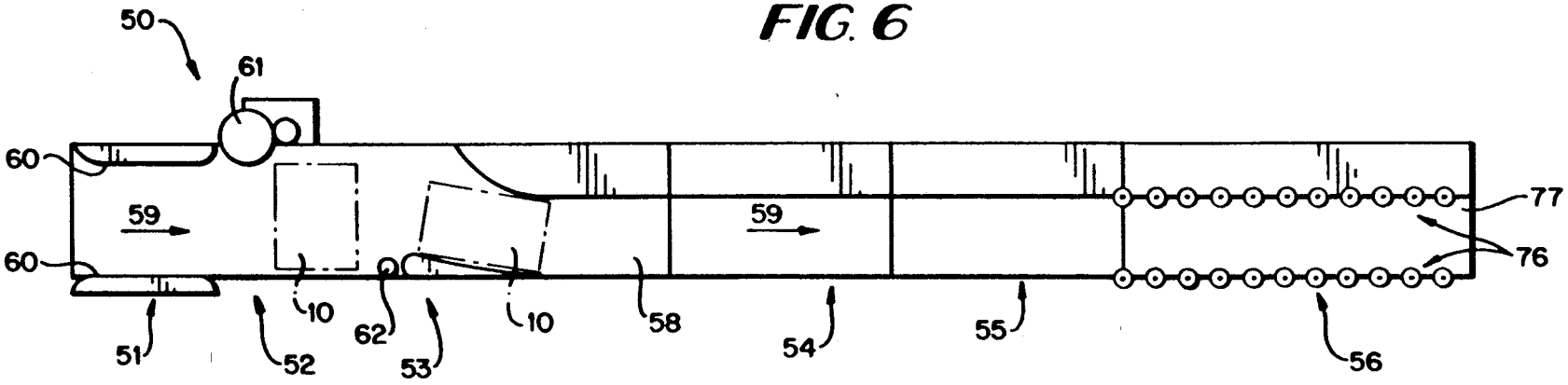
FIG. 6 is a top plan schematic view of exemplary apparatus according to the invention for packing a carton.
Figure 7:
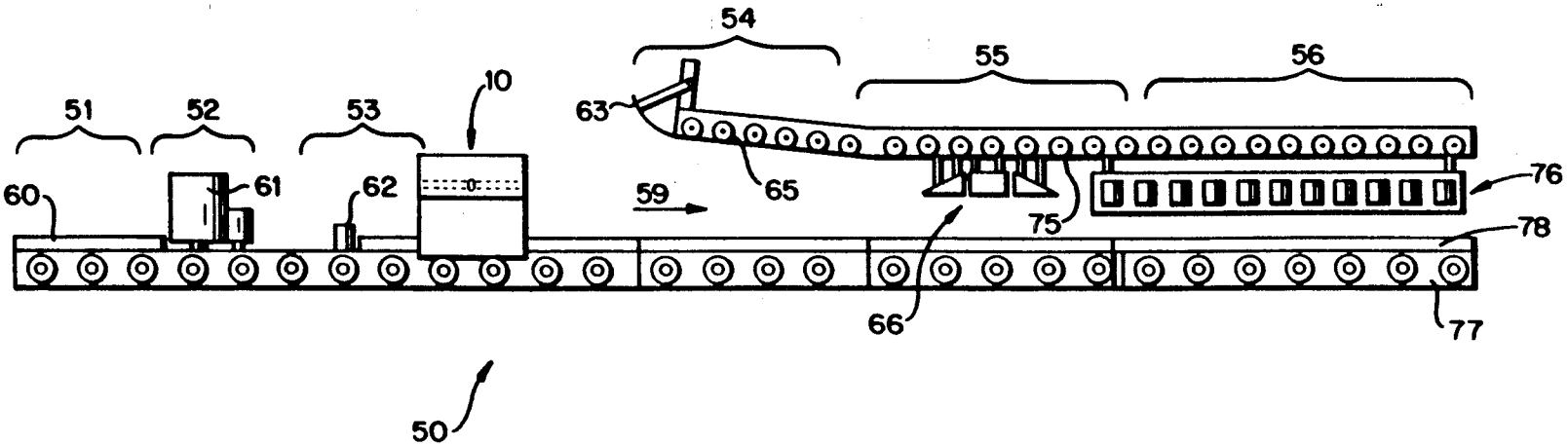
FIG. 7 is a side schematic view of the apparatus of FIG. 6.

FIGS. 6 through 8 schematically illustrate apparatus according to the invention for packing a cardboard carton, such as the carton 10. The apparatus is illustrated generally at 50 in FIGS. 6 and 7, and includes an aligning section 51, an encoding section 52, a turning section 53, a compressing section or stage 54, an affixing, bonding, or adhesion stage 55, and a further compression and accumulation stage 56. The apparatus 50 includes a conventional conveyor 58, such as powered horizontal axis rollers, which transport the carton 10 up to the last section 56. The carton is conveyed in the direction of arrow 59 in FIGS. 6–8, the carton 10 first being aligned by the guides 60, and then being encoded by the encoding wheel 61, engaging the turning post 62, and then being turned so that the elongated (side) panels face in the direction of conveyance 59.

When moving in direction 59, the carton 10 (comprising lid 11 and body 12) encounters a guide or cam 63 which engages the lid 11 and gradually moves it into contact with the upper horizontal axis rollers 65, which—as illustrated in FIG. 7—are disposed at an angle with respect to the power rollers 58 so that the distance between the rollers 65 and the rollers 58 is gradually decreased as the carton 10 moves in the direction of conveyance 59. This action compresses the carton 10, removing a significant amount of the void volume within the carton since the product in the carton is above the top edge 16 of the carton body 12 (see FIG. 3). While the carton 10 is held in this compressed condition, it engages the gluing or adhesion apparatus 66.

The gluing or adhesion apparatus 66—as seen most clearly in FIG. 8—preferably comprises a first element 67 having a wedge shape including a cam surface 68 which engages the side panel 22 at the bottom section 27 thereof and cams it outwardly, away from the side wall 14 of the carton bottom 12. The bottom section 27 of the side panel 22 then comes in contact with the glue applicator 69, which has surfaces 70, 71 thereof which respectively engage the inside of the side panel 22, and the exterior of the side wall 14. Glue may be applied by one or both of the surfaces 70, 71 to the cardboard. In FIG. 8 the surface 70 of applicator 69 has applied the glue 45 to the interior surface of the side panel 22 bottom section 27, which is then cammed back into contact with the side panel 14 by the element 72 having a wedge shape, including the linear cam portion 73. During this entire time, the rollers 75—rotatable about a horizontal axis—maintain a compressive force on the lid 11.

After passing through the affixing stage 55, the carton 10 enters the accumulation stage 56 which includes means for maintaining the compressive force on the lid and applying an inward compressive force to the side panels to adhesively bond the side panels to the side walls of the carton. Preferably two rows of vertical axis rollers 76 are provided, with an adjustable spacing therebetween and preferably is spaced in such a way—or biased by springs or the like—so that they apply an inward force to the side panels 22. In the stage 56 the top rollers 75 are continued, and also bottom rollers 77 are provided, the rollers 77—unlike the rollers 58—being nonpowered. In addition to maintaining compression of the lid 11 on the carton body 12, stage 56 also accumulates cartons. Guides 78, like guides 60, also may be provided. Most plants, although utilized differently than as described above, have existing apparatus like that in stage 56.

While particular apparatus has been described above, it is to be understood that the apparatus described is totally exemplary, and that many other inexpensive comparable components can be utilized for performing the same functions. For example, the rollers 65, 75 can be spring biased downwardly, rods or other pressure bearing devices may be utilized instead of the vertical axis rollers 76, etc. Also, while the elements of the gluing section 66 are illustrated as supported from above—with supports exteriorly of the carton sides and extending downwardly to below the elements 67, 69, 72—they can, of course, be supported by legs upstanding from the bottom stationary side edges of the conveyor 58. Further, glue application in section 55 may be by spraying, extruding, or positively flowing onto the cardboard; or replaced by automatic stapling equipment, or automatic taping equipment (e.g. using security thread or security printed pressure sensitive or gummed tape).

It will be seen that the apparatus according to the invention is simple and relatively inexpensive, yet allows effective automatic packing of a carton. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and apparatus.

What is claimed is:

1. Apparatus for packing and securing a cardboard carton having a body and a lid with material to be packed disposed within the body and supporting the lid, the lid having side panels overlapping the body side walls, said apparatus comprising:

means for providing a compressive force to said lid so that said lid moves downwardly toward said carton body top edge;

means for moving said lid overlapping side panels away from the carton side walls, and applying adhesive thereto and/or to the cooperating portions of the carton side walls at the same time as said means for providing a compressive force applies a force to said lid pushing it downwardly; and means for maintaining compressive force on said lid and applying inward compressive force to said lid overlapping side panels to adhesively bond the overlapping side panels to the side walls.

2. Apparatus as recited in claim 1 wherein said means for providing a compressive force comprises a bottom conveying means for engaging the carton, and an upper conveying means having a portion thereof disposed at an angle so that the spacing between the bottom conveyor and the upper conveyor decreases as the carton moves in the direction of conveyance.

3. Apparatus as recited in claim 1 wherein said means for moving said lid overlapping side panels away from the carton side walls and applying adhesive thereto comprise a wedge shaped cam element for movement between the lid side panels and the carton body side wall disposed on each side of the carton to cam the side panel away from the carton wall, and an adhesive applicator for transferring adhesive to at least one of the interior of the side panel of exterior of the carton side wall as it moves therepast.

4. Apparatus as recited in claim 1 wherein said means for maintaining a compressive force comprises a plurality of vertical axis rollers engaging the side sections of the carton lid.

5. Apparatus for packing and securing a cardboard carton having a body and a lid with material to be packed disposed within the body and supporting the lid, the lid having side panels overlapping the body side walls, said apparatus comprising:

means for providing a compressive force to said lid so that said lid moves downwardly toward said carton body top edge, comprising a bottom conveying means for engaging the carton, and an upper conveying means having a portion thereof disposed at an angle so that the spacing between the bottom conveyor and the upper conveyor decreases as the carton moves in the direction of conveyance;

means for moving said lid overlapping side panels away from the carton side walls, and applying adhesive thereto and/or to the cooperating portions of the carton side walls; and means for maintaining compressive force on said lid and applying inward compressive force to said lid overlapping side panels to adhesively bond the overlapping side panels to the side walls.

6. Apparatus as recited in claim 5 wherein said means for maintaining a compressive force comprises a plurality of vertical axis rollers engaging the side sections of the carton lid.

7. Apparatus as recited in claim 5 wherein said bottom conveying means has a carton aligning section at an inlet thereto, and a carton turning section adjacent said carton aligning section and before said upper conveying means, to effect proper orientation of the carton before it engages said upper conveying means.

8. Apparatus as recited in claim 6 wherein said means for moving said lid overlapping side panels away from the carton side walls and applying adhesive thereto comprise a wedge shaped cam element for movement between the lid side panels and the carton body side wall disposed on each side of the carton to cam the side panel away from the carton wall, and an adhesive applicator for transferring adhesive to at least one of the interior of the side panel or exterior of the carton side wall as it moves therepast.

9. Apparatus for packing and securing a cardboard carton having a body and a lid with material to be packed disposed within the body and supporting the lid, the lid having side panels overlapping the body side walls, said apparatus comprising:

means for providing a compressive force to said lid so that said lid moves downwardly toward said carton body top edge, comprising a bottom conveying means for engaging the carton, and an upper conveying means having a portion thereof disposed at an angle so that the spacing between the bottom conveyor and the upper conveyor decreases as the carton moves in the direction of conveyance;

means for attaching said lid overlapping side panels to the carton side walls; and means for maintaining compressive force on said lid and applying inward compressive force to said lid overlapping side panels coincident with action by said means for attaching said lid overlapping side panels to the carton side walls.

10. Apparatus as recited in claim 9 wherein said means for providing a compressive force comprises a bottom conveying means for engaging the carton, and an upper conveying means having a portion thereof disposed at an angle so that the spacing between the bottom conveyor and the upper conveyor decreases as the carton moves in the direction of conveyance.

11. Apparatus as recited in claim 9 wherein said means for maintaining a compressive force comprises a plurality of vertical axis rollers engaging the side sections of the carton lid.

12. Apparatus as recited in claim 9 wherein said means for attaching said lid overlapping side panels to the carton side walls comprises means for applying adhesive to the lid side panels and/or carton side walls.

13. Apparatus as recited in claim 12 wherein said means for attaching said side panels to said carton comprises means for moving said lid overlapping side panels away from the carton side walls and applying adhesive thereto, said means including a wedge shaped cam element for movement between the lid side panels and the carton body side wall disposed on each side of the carton to cam the side panel away from the carton wall, and an adhesive applicator for transferring adhesive to at least one of the interior of the side panel or exterior of the carton side wall as it moves therepast.

14. Apparatus for packing and securing a cardboard carton having a body and a lid with material to be packed disposed within the body and supporting the lid, the lid having side panels overlapping the body side walls, said apparatus comprising:

means for moving said lid overlapping side panels away from the carton side walls, and applying adhesive thereto and/or to the cooperating portions of the carton side walls, said means comprising a wedge shaped cam element for movement between the lid side panels and the carton body side wall disposed on each side of the carton to cam the side panel away from the carton wall, and an adhesive applicator for transferring adhesive to at least one of the interior of the side panel or exterior of the carton side wall as it moves therepast; and means for applying an inward compressive force to said lid overlapping side panels to adhesively bond the overlapping side panels to the side walls.

15. Apparatus for packing and securing a cardboard carton having a body and a lid with material to be packed disposed within the body and supporting the lid, the lid having side panels overlapping the body side walls, said apparatus comprising:

means for providing a compressive force to said lid so that said lid moves downwardly toward said carton body top edge;

means for attaching said lid overlapping side panels to the carton side walls;

means for maintaining compressive force on said lid and applying inward compressive force to said lid overlapping side panels coincident with action by said means for attaching said lid overlapping side panels to the carton side walls; and a bottom conveying means engaging the bottom of a carton, said bottom conveying means comprising a carton aligning section at an inlet thereto, and a carton turning post adjacent said carton aligning section.

16. Apparatus for packing and securing a cardboard carton having a body and a lid with material to be packed disposed within the body and supporting the lid, the lid having side panels overlapping the body side walls, said apparatus comprising:

means for providing a compressive force to said lid so that said lid moves downwardly toward said carton body top edge;

means for moving said lid overlapping side panels away from the carton side walls, and applying adhesive thereto and/or to the cooperating portions of the carton side walls, comprising wedge shaped cam element for movement between the lid side panels and the carton body side wall disposed on each side of the carton to cam the said panel away from the carton wall, and an adhesive applicator for transferring adhesive to at least one of the interior of the side panel or exterior of the carton side wall as it moves therepast; and means for maintaining compressive force on said lid and applying inward compressive force to said lid overlapping side panels to adhesively bond the overlapping side panels to the side walls.

17. Apparatus for packing and securing a cardboard carton having a body and a lid with material to be packed disposed within the body and supporting the lid, the lid having side panels overlapping the body side walls, said apparatus comprising:

means for providing a compressive force to said lid so that said lid moves downwardly toward said carton body top edge;

means for applying adhesive to the lid side panels and/or carton side walls to attach said lid overlapping side panels to the carton side walls at the same time as said means for providing a compressive force applies a force to said lid pushing it downwardly; and means for maintaining compressive force on said lid and applying inward compressive force to said lid overlapping side panels coincident with action by said means for attaching said lid overlapping side panels to the carton side walls.

18. Apparatus as recited in claim 17 wherein said bottom conveying means has a carton aligning section at an inlet thereto, and a carton turning section adjacent said carton aligning section and before said upper conveying means, to effect proper orientation of the carton before it engages said upper conveying means.

* * * * *